US006531832B1

(12) United States Patent
Hirata et al.

(10) Patent No.: US 6,531,832 B1
(45) Date of Patent: Mar. 11, 2003

(54) DISCHARGE LAMP AND ELECTRONIC FLASH DEVICE USING THE SAME

(75) Inventors: Shinji Hirata, Osaka (JP); Haruhiko Yuhara, Osaka (JP)

(73) Assignee: West Electric Co., Ltd., Osaka (JP)

( * ) Notice: Subject to any disclaimer, the term of this patent is extended or adjusted under 35 U.S.C. 154(b) by 0 days.

(21) Appl. No.: 09/958,991

(22) PCT Filed: Apr. 25, 2000

(86) PCT No.: PCT/JP00/02680

§ 371 (c)(1),
(2), (4) Date: Dec. 14, 2001

(87) PCT Pub. No.: WO00/67296

PCT Pub. Date: Nov. 9, 2000

(30) Foreign Application Priority Data

Apr. 28, 1999 (JP) ..... 11-122135

(51) Int. Cl.[7] ..... H05B 37/00

(52) U.S. Cl. ..... 315/241 P; 315/134; 315/158; 315/DIG. 5; 313/594; 313/602; 313/633

(58) Field of Search ..... 315/241 P, 241 R, 315/134, 135, 136, 151, 158, DIG. 5; 313/594, 595, 601, 602, 607, 636, 633

(56) References Cited

U.S. PATENT DOCUMENTS

| | | | | |
|---|---|---|---|---|
| 3,634,718 A | * | 1/1972 | Larson | 313/570 |
| 3,758,819 A | | 9/1973 | Goldberg | 315/204 |
| 3,968,392 A | | 7/1976 | Buchta et al. | 313/594 |
| 4,001,624 A | | 1/1977 | Cosco et al. | 313/573 |
| 4,082,982 A | | 4/1978 | Hirata | 315/151 |
| 4,179,640 A | * | 12/1979 | Larson et al. | 315/47 |
| 5,304,897 A | | 4/1994 | Sano et al. | 315/209 R |
| 5,729,095 A | * | 3/1998 | Shimokawa et al. | 315/176 |

FOREIGN PATENT DOCUMENTS

EP 0 473 164 3/1992

OTHER PUBLICATIONS

Patent Abstracts of Japan, vol. 007, No. 008 (E–152), Jan. 13, 1983 & JP 57 165948 A (Ricoh KK), Oct. 13, 1982 Abstract; Figures 4, 6A, 6B.

Patent Abstracts of Japan, vol. 010, No. 348 (P–519), Nov. 22, 1986 & JP 61–147242 A (Ushio Inc), Jul. 4, 1986, Abstract.

Patent Abstracts of Japan, vol. 005, No. 019 (E–044), Feb. 4, 1981 & JP 55 146856 A (Ushio Inc), Nov. 15, 1980, Abstract.

* cited by examiner

*Primary Examiner*—Haissa Philogene
(74) *Attorney, Agent, or Firm*—Wenderoth, Lind & Ponack, L.L.P.

(57) ABSTRACT

In a discharge lamp, at least one of two main electrodes disposed at both ends of the discharge lamp includes one main electrode that comprises a sintered metal member having a slope with respect to another main electrode. A tip of the slope is positioned within a space covered by a trigger electrode coated on an outer surface of the discharge lamp in a limited area with respect to the entire circumference of a bulb of the lamp. This structure allows the discharge lamp to emit light at a stable level constantly. An electronic flash device using this discharge lamp can emit the light precisely.

16 Claims, 5 Drawing Sheets

DISCHARGE LAMP AND ELECTRONIC FLASH DEVICE USING THE SAME

TECHNICAL FIELD

The present invention relates to discharge lamp employed as an artificial light source in an electronic flash device incorporated in a photographic camera, and the electronic flash device mounted to a photographic camera. More particularly, the present invention relates to a discharge lamp emitting stable light by stabilizing a discharge current and an emitting waveform, and the electronic flash device using the same lamp.

BACKGROUND ART

FIG. 8 is a cross section of a conventional discharge lamp.

In FIG. 8, main electrodes 118 and 121 are sealed at both the ends of glass bulb 117. Trigger electrode 122 made of transparent and conductive coating is provided on the entire outer surface of bulb 117. Bulb 117 contains a necessary amount of rare gas such as xenon. Main electrode 118 comprises metallic member 119 and sintered metal member 120 mounted to the tip of metallic member 119. Metallic member 119 is made of tungsten, Kovar or the like. Sintered metal member 120 is made by sintering tungsten powder, tantalum powder, or mixed powder of tungsten and tantalum.

The conventional discharge lamp structured above is built in, e.g. an electronic flash device as shown in FIG. 9. FIG. 9 illustrates an automatic electronic flash device which automatically controls the amount of light emitted from the discharge lamp by sensing the light radiated to a photographic object. Power source 123 supplies a high voltage (approx. 300V), and charges main-discharging capacitor 124 with a charging current, thus approx. 300V is applied across capacitor 124. Trigger circuit 125 produces a high trigger voltage to energize discharge lamp 126. Light-emitting control section 127 stops discharge lamp 126 to emit the light on its way. Photo-receptor 128 comprises photo-receiving element 129 and circuit 130 producing a light-emitting-stopping signal.

An operation of the conventional automatic electronic flash device structured above is described hereinafter.

Capacitor 124 is charged at a high voltage with the charging current from power source 123. Trigger circuit 125 is activated to apply a high voltage to a trigger electrode of discharge lamp 126. Then discharge lamp 126 is energized to emit light by charged energy stored in capacitor 124, thereby radiating a photographic object. The light reflected from the object enters photo-receiving element 129. When the amount of light entering to photo-receiving element 129 reaches a given amount, circuit 130 outputs a light-emitting-stopping signal to light-emitting control section 127. Section 127 then conducts switching operation thereby stopping the discharge lamp 126 to emit the light.

FIG. 10 shows waveforms of discharge-current of the conventional discharge lamp. FIG. 11 shows waveforms of the light emitted from the same bulb. Discharge lamp 126 is energized with a trigger voltage produced by trigger circuit 125, and lamp 126 is discharged by the energy charged in capacitor 124. The waveforms in FIG. 10 illustrate time-varient discharge current. This discharge-current rises sharply approx. at the same time when the trigger voltage is applied, and then starts flowing. When light-emitting-stopping section 127 does not operate switching on the way of emitting the light, i.e. when section 127 is in a complete emitting mode, this flash device finishes discharging by consuming all energy charged in capacity 124 toward an photographic object away from the camera.

On the other hand, brightness of discharge lamp 126 starts increasing not simultaneously with the start of flowing the discharge current but with some time lag, as shown in FIG. 11. When the conventional discharge lamp shown in FIG. 8 is employed, the discharge current of this bulb 126 draws different waveforms marked with 200 and 250 in FIG. 10 at each firing of the lamp, and no stable waveforms are obtained. Light emission of lamp 126 also draws different waveforms marked with 300 and 350 in FIG. 11 at each firing, and no stable waveforms are obtained. In particular, the unstable light emission waveforms as shown in FIG. 11 cause a reduction in precision in automatic light emission control.

It is necessary to detect precisely an amount of reflective light—out of the light emitted from discharge lamp 126—from a photographic object for realizing precise control over the light emission from lamp 126. For that purpose, photo receptor 128 should synchronizes exactly with an emission timing of lamp 126. There are two methods for activating photo receptor 128; (1) Trigger circuit 125 energizes discharge lamp 126, and the discharge current shown in FIG. 10 starts flowing. At the same time, an operable voltage is supplied to photo-receptor 128. (2) When the discharge current reaches a given amount, this is detected and then the operable voltage is supplied to photo-receptor 128.

When method (2) is employed for powering photo-receptor 128, light-emitting waveform varies every time the discharge lamp fires as shown in FIG. 11 and this causes the following inconvenience: Although photo receptor 128 is ready to detect reflective light from the object, if lamp 126 would delay emitting as shown with waveform 350, receptor 128 receives external lights other than the reflective light from the object during this delay, i.e. a period before lamp 126 starts emitting. Then, receptor 128 cannot receive the reflective light exactly from the object, and thus the light amount radiated to the object is less than an appropriate amount.

On the contrary, when photo-receptor 128 starts operating later than discharge lamp 126, e.g. as shown with waveform 300 in FIG. 11, lamp 126 have already started emission before receptor 128 becomes ready to receive the reflective light from the object. The reflective light is thus not received by receptor 128 until receptor 128 is ready, and thus the light amount radiated to the object exceeds the appropriate amount.

The discussion described above proves that a slight time lag between a light emission timing and an operation start timing of the photo-receptor affects the amount of light emission only a little when the object is away from the camera. However, it affects the amount of light emission substantially when the object is close to the camera.

Independent of the prior art discussed above, Japanese Patent Application Non-Examined Publication No. S57-165948 discloses a flash discharge lamp of which noise at turning on to the peripheral systems is reduced. In this lamp, electrodes of anode and cathode are disposed closely to a line trigger electrode provided along the outer wall of a glass tube. This arrangement allows an instantaneous voltage drop in a waveform of a trigger signal to be reduced, thereby lowering the noise. The electrodes of anode and cathode are closely disposed to the line trigger electrode, so that discharge between the anode and cathode occurs along the trigger electrode. This may somewhat contribute to stabilizing discharge current and discharged light emitting comparing with the method previously discussed; however, this method still does not produce a satisfactory result because of the following reason: Indeed, the section, where the electrodes of anode and cathode are closely placed to trigger electrode 4, forms an acute angle comparing with the center section of the glass tube; however, the anode and cathode face each other in parallel, so that the discharged current and the waveform of light emitted are not always stabilized while the waveform of a trigger signal is stabilized due to the acute angle formed by the anode and cathode is closely placed to the trigger electrode.

SUMMARY OF THE INVENTION

The present invention addresses the problem discussed above and aims to provide a discharge lamp emitting light with stable waveforms of both discharge-current and light-emission. This discharge lamp is employed in an electronic flash device which emits the light by consuming the energy charged in a main capacitor, so that the electronic flash device emitting stable light is obtainable.

The discharge lamp of the present invention comprises the following elements:

(a) a glass bulb;

(b) a pair of main electrodes sealed in at both ends of the bulb;

(c) a trigger electrode provided on outer surface of the glass bulb in part in circumference direction and in a longitudinal direction of the bulb; and (d) rare gas sealed in the bulb.

At least one of the main electrodes includes a metallic member sealed at a first end of the bulb and sintered metal member disposed in the bulb and mounted to this metallic member. The sintered metal member slopes with respect to another main electrode opposite thereto and the tip of the slope is positioned within a limited space covered by the trigger electrode.

This structure allows the discharge lamp to produce constantly stable waveforms of both the discharge current and light emission.

An electronic flash device of the present invention comprises the following elements:

(a) a power source;

(b) a main discharging capacitor to be charged by the power source;

(c) a trigger circuit; and (d) the discharge lamp discussed above having a trigger electrode on an outer surface of a glass bulb—the trigger circuit applying a voltage to the trigger electrode—for emitting light by consuming energy charged in the main discharging capacitor.

The discharge lamp of the present invention is used in the electronic flash device discussed above, so that the device produces constantly stable waveform of light emission. When the discharge lamp is employed in an automatic electronic flash device that controls light emission automatically, precise control over light emission can be expected. The automatic light emission control stops the lamp to emit the light when received amount of reflective light—out of emitted light of the discharge lamp—from a photographic object reaches an appropriate amount.

DETAILED DESCRIPTION OF PREFERRED EMBODIMENTS

Exemplary embodiments of the present invention are demonstrated with reference to the accompanying drawings.

Exemplary Embodiment 1

Figure 1:
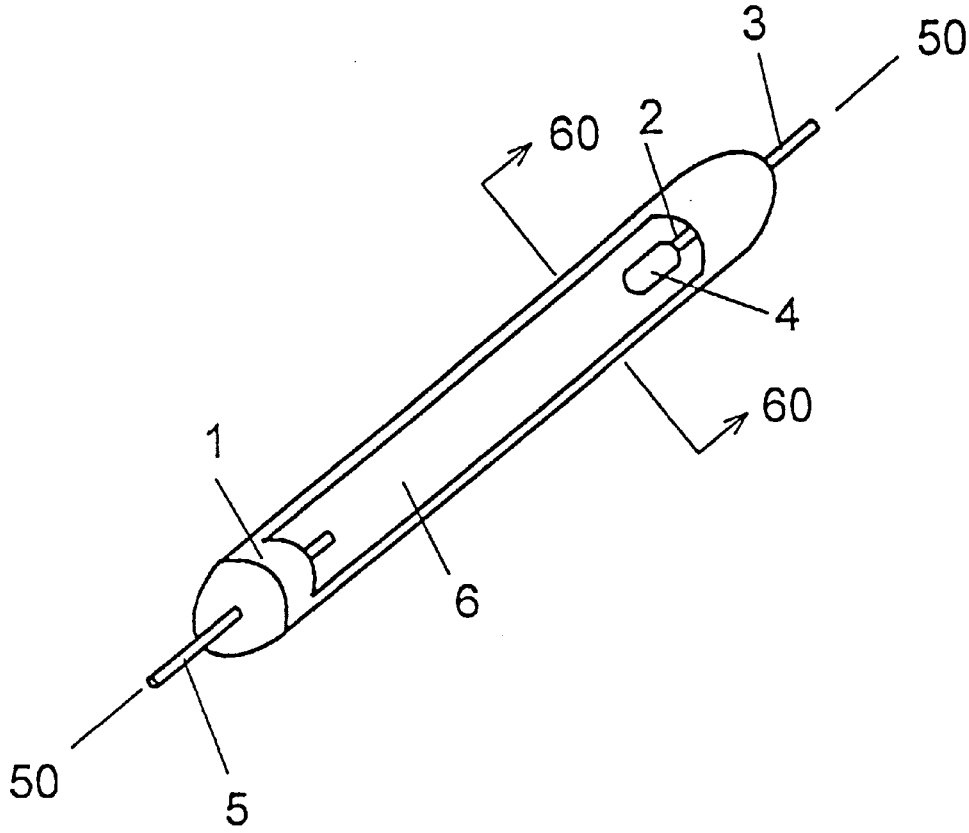
FIG. 1 is a perspective view of a discharge lamp in accordance with a first exemplary embodiment of the present invention.
Figure 2:
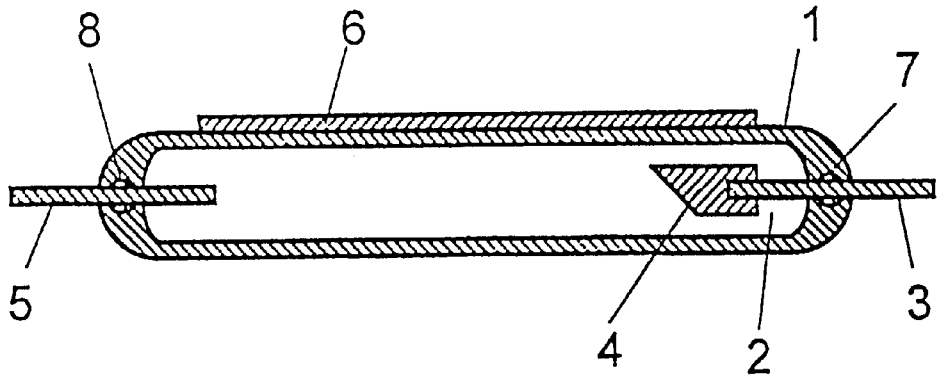
FIG. 2 is a cross section of the discharge lamp taken on lines 50—50 in FIG. 1.
Figure 3:
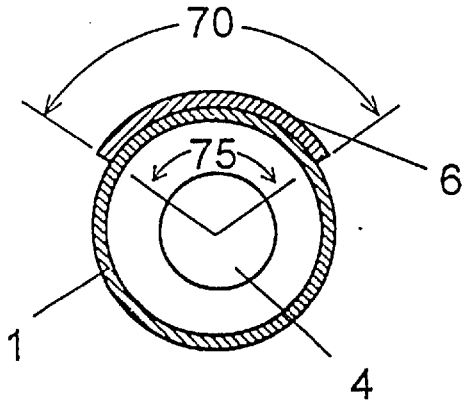
FIG. 3 is a cross section of the discharge lamp taken on lines 60—60 in FIG. 1.
Figure 4:
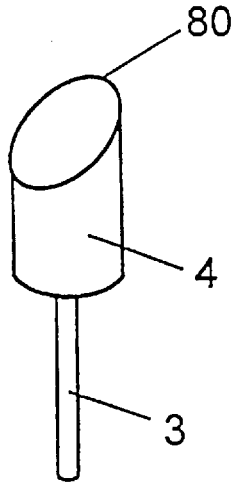
FIG. 4 is an enlarged perspective view of a main electrode of the discharge lamp.
Figure 5:
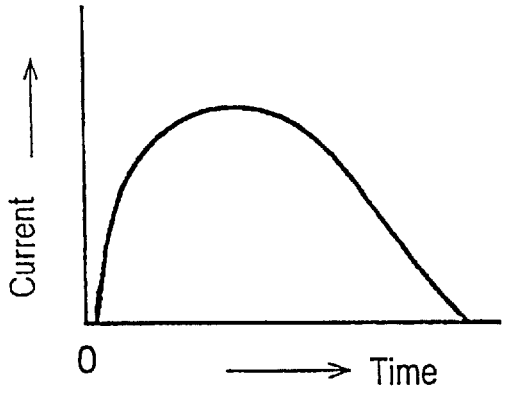
FIG. 5 shows a waveform of discharge current of the discharge lamp.
Figure 6:
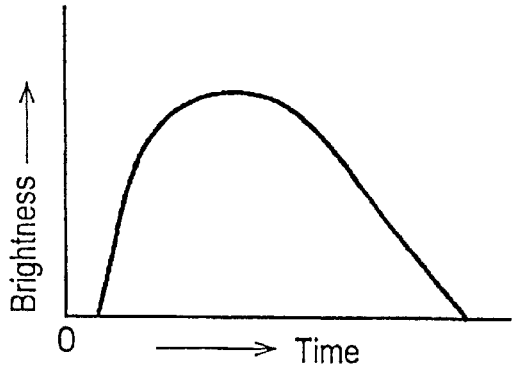
FIG. 6 is a waveform of emitted light from the discharge lamp.

FIG. 1 is a perspective view of a discharge lamp in accordance with the first exemplary embodiment of the present invention. FIG. 2 is a cross section of the same discharge lamp taken on lines 50—50 in FIG. 1, and FIG. 3 is a cross section of the same discharge lamp taken on lines 60—60 in FIG. 1. FIG. 4 is an enlarged perspective view of a main electrode of the same discharge lamp. FIG. 5 shows a waveform of discharge-current of the same discharge lamp, and FIG. 6 is a waveform of emitted light from the same discharge lamp.

In FIG. 1 and FIG. 2, main electrodes 2 and 5 are sealed at both the ends of glass bulb 1. First main electrode 2 has metallic member 3 and sintered metal member 4. Metallic member 3 is formed by cutting a stick of tungsten, Kovar or the like. Sintered metal member 4 is made by solidifying powder of tungsten or tantalum, or mixed powder of them, and sintering the solid powder. Sintered metal member 4 is mounted to the tip of metallic member 3 by welding or caulking.

FIG. 4 is an enlarged perspective view of a main electrode of the same discharge lamp. In FIG. 4, sintered metal member 4 is shaped in a cylinder having a slope on a first end, and mounted to metallic member 3 at a second end. Another main electrode 5 sealed at another end of the bulb 1 is made of the same material as metallic member 3.

Trigger electrode 6 is made of transparent and conductive coating coated in a longitudinal direction on the outer surface of bulb 1. The coated area is limited by angle 75, shown in FIG. 3, with respect to the entire circumference of bulb 1.

In FIG. 2, a necessary amount of rare gas such as xenon gas is sealed in bulb 1. Bead-glasses 7 and 8 are used for sealing main electrodes 2 and 5 within bulb 1. Main electrode 2 is sealed in bulb 1 at a first end of bulb 1 so that upper tip 80, shown in FIG. 4, of sintered metal member 4 is located within area 70, shown in FIG. 3, above which trigger electrode 6 is coated.

In the discharge lamp of the present invention structured above, trigger electrode 6 is coated on an area limited by an angle of 90 degree with respect to the axis of bulb 1 and in a longitudinal direction of bulb 1. This discharge lamp replaces a conventional discharge lamp 126 used in an electronic flash device shown in FIG. 9, and various data are measured. The resultant data are described below.

The electronic flash device is fired ten times in a complete emitting mode, and discharge current as well as light emitted are observed each time. FIG. 5 and FIG. 6 show these data. Each Fig. shows only one waveform because the discharge current and the light emitted are hardly changed by each firing in respective waveforms, thus the waveforms are stable enough, although the conventional device have shown different waveforms at each firing.

The first embodiment as discussed above proves that the discharge lamp of the present invention can produce stable waveforms of the discharge current and light emitted. An electronic flash device using this discharge lamp can constantly emit the light with a stable waveform. In particular, when this discharge lamp is used in an automatic electronic flash device, light emission can be precisely controlled. The automatic electronic flash device allows the discharge lamp to stop emitting the light when the received amount of reflective light, out of the light emitted, from a photographic object reaches an appropriate amount.

Exemplary Embodiment 2

Figure 7:
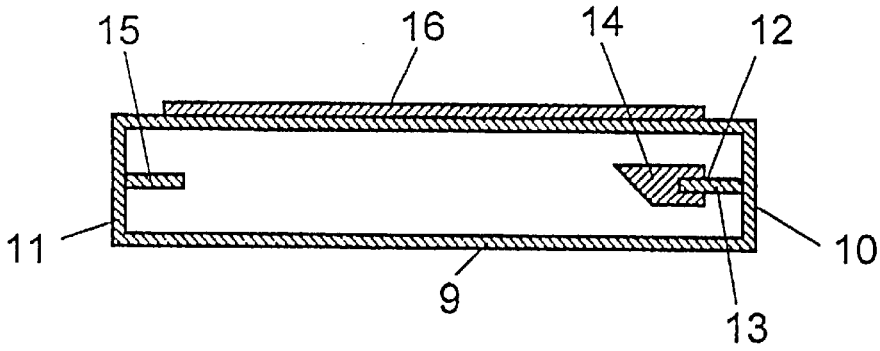
FIG. 7 is a cross section of a discharge lamp in accordance with a second exemplary embodiment of the present invention.

FIG. 7 is a cross section of a discharge lamp in accordance with the second exemplary embodiment of the present invention.

In this second embodiment, both the ends of glass bulb 9 are shielded with metallic sealant members 10 and 11. Main electrode 12 and 15 are mounted to sealant members 10 and 11 respectively. Electrode 12 is made of the same material as main electrode 2 used in the first embodiment. Electrode 15 is made of tungsten, Kovar or the like. Trigger electrode 16 is, as same as in the first embodiment, coated on the outer surface of bulb 9 in the longitudinal direction and in part with respect to the entire circumference of bulb 9. A necessary amount of rare gas such as xenon is sealed in bulb 9. A relative positional relation between trigger electrode 16 and main electrode 12 is the same as the first embodiment. The second embodiment can effect the same advantages as the first.

Figure 8:
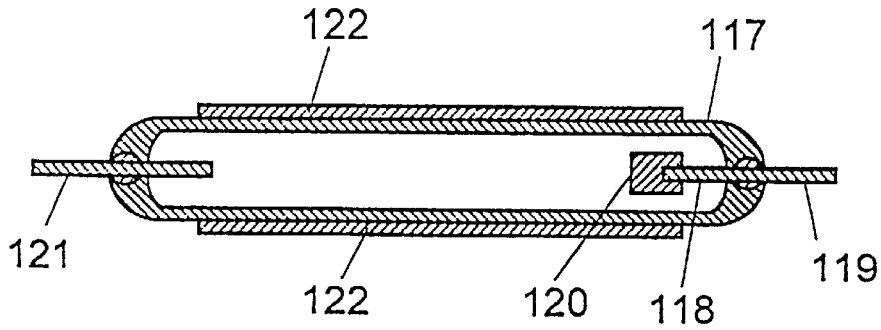
FIG. 8 (PRIOR ART)
FIG. 8 is a cross section of a conventional discharge lamp.

In the first and second embodiments discussed above, main electrodes 2 and 12 are made of sintered metal member and shaped in a cylinder having a slope on the first end as shown in FIG. 4. A polygonal pillar, e.g. a pentagon pillar or hexagon pillar, having a slope on its first end can replace the cylinder. Main electrode 5 is made of a single metal; however it can be made of the same material as electrode 2, or it can be replaced with main electrode 118 of the conventional discharge lamp shown in FIG. 8.

Main electrode 12 shown in FIG. 7 and used in the second embodiment can be formed by mounting only sintered metal member 14 directly to metallic sealant member 10, instead of mounting sintered metal member 14 to metallic member 13. Main electrode 15 can be made of the same material as main electrode 12 or sintered metal only instead of the metallic member.

Regarding the relative positional relation between trigger electrode 6 or 16 and the tip of main electrode 2 or 12, the center of tip preferably meets the center of the limited area coated by the trigger electrode. However, the center of tip can be positioned at any place within the limited space.

Figure 10:
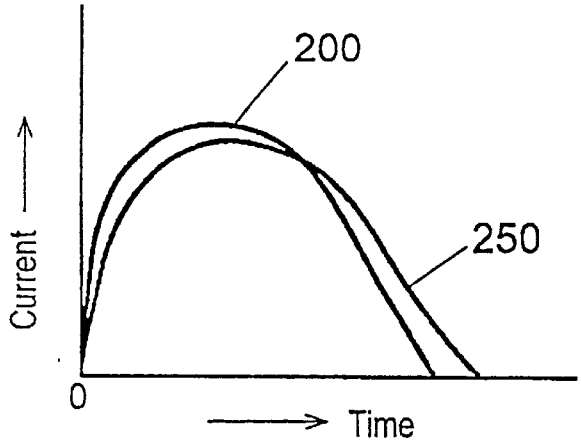
FIG. 10 (PRIOR ART)
FIG. 10 shows a waveform of discharge current of the conventional discharge lamp.
Figure 11:
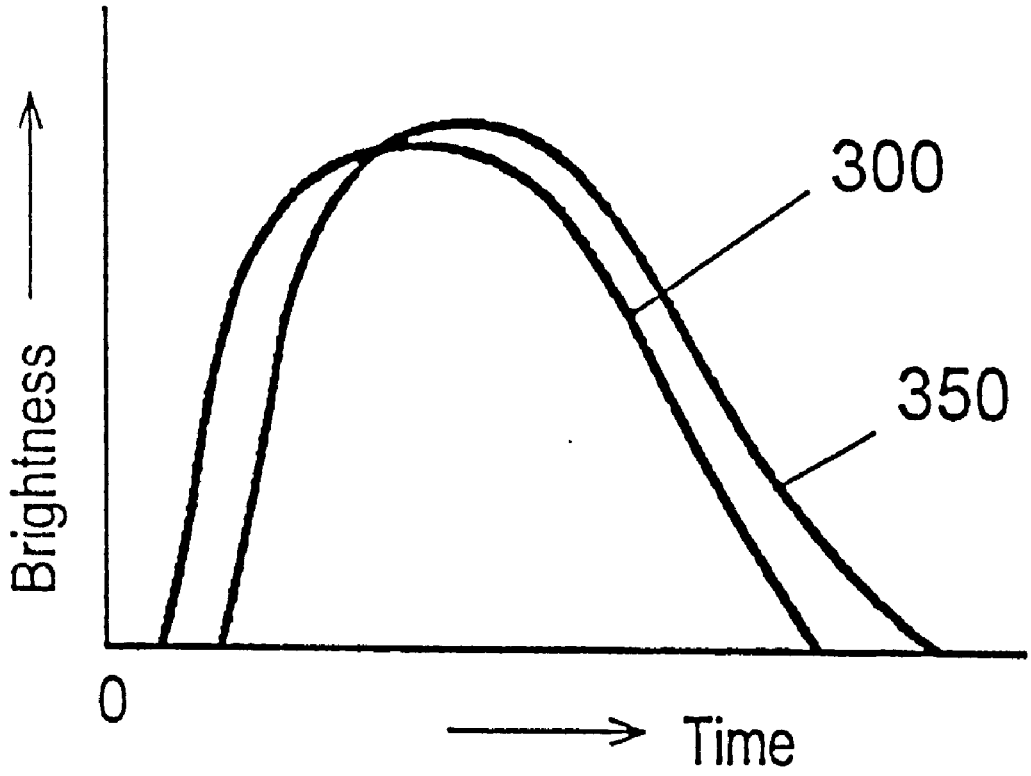
FIG. 11 (PRIOR ART)
FIG. 11 shows a waveform of light emitted from the conventional discharge lamp.

Regarding the limited area coated by trigger electrode with respect to the entire circumference of the bulb in both the embodiments, an angle with respect to the axis of the bulb can range from 10° to 200°. This range of angle produces stable light emission free from any practical problems. However, if the angle is less than 10°, the tip of main electrode is laid possibly out of the limited space covered by the trigger electrode in the assembling of the discharge lamp. Therefore, angle 75 shown in FIG. 3 needs at least 10°. When angle 75 exceeds 200°, the waveforms of discharge-current and light-emission become unstable as shown in FIG. 10 and FIG. 11.

The exemplary embodiments of the discharge lamp of the present invention are described above with reference to the accompanying drawings, and when the discharge lamp is used in an electronic flash device, stable waveforms of light emission can be constantly produced by the device.

Figure 9:
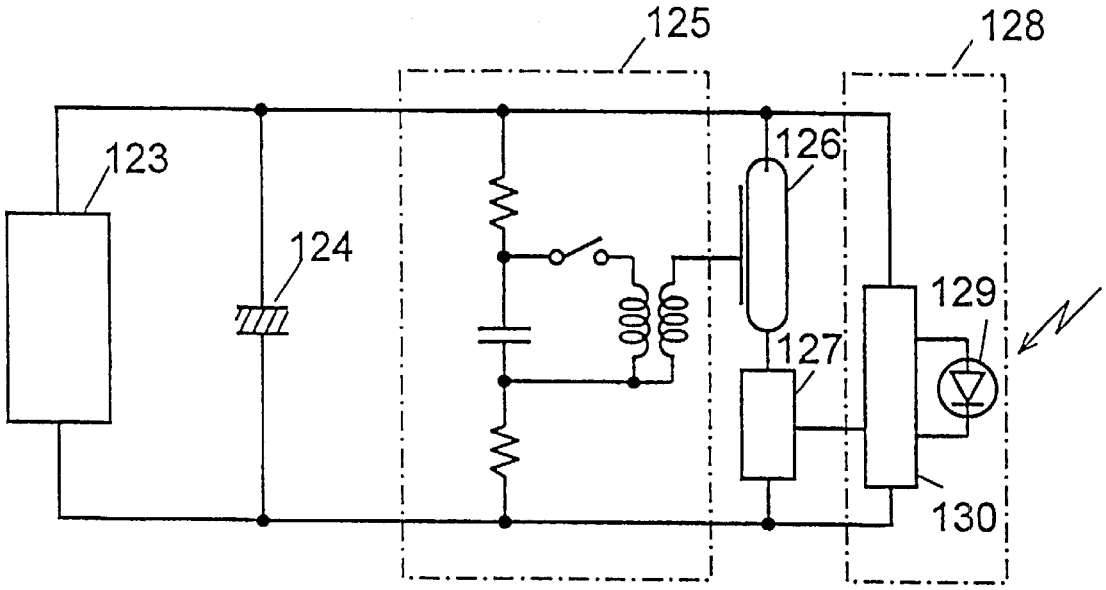
FIG. 9 (PRIOR ART)
FIG. 9 is an electric circuit of an electronic flash device, for general use, that can automatically control light-emission.

When the discharge lamp is used in an automatic electronic flash device shown in FIG. 9, a highly precise automatic electronic flash device is achievable.

The discharge lamp of the present invention, as discussed above, has the following structure: at least one of two main electrodes slopes with respect to the opposite main electrode, and the tip of the slope is positioned in a limited space covered by the trigger electrode coated on the outer surface of the discharge lamp. The coated area is in the longitudinal direction and in part with respect to the entire circumference of the bulb. This structure allows the bulb to produce constantly stable waveforms of discharge current and light emission of the discharge lamp. An electronic flash device employing this discharge lamp can constantly produce a stable waveform of light emission. In particular, when this discharge lamp is used in an automatic electronic flash device, the light emission can be controlled precisely.

Industrial Applicability

The present invention relates to discharge lamps and electronic flash devices employing the same lamps. In the discharge lamp of the present invention, at least one of two main electrodes slopes with respect to the opposite main electrode, and the tip of the slope is positioned in a limited space covered by the trigger electrode coated in a limited area on the outer surface of the discharge lamp. This structure allows the bulb to emit stable light constantly. This discharge lamp is employed in an electronic flash device, so that the light emission can be controlled precisely.

What is claimed is:

1. A discharge lamp comprising:

a glass bulb;

a pair of main electrodes sealed in at both ends of said glass bulb, respectively;

a trigger electrode provided on an outer surface of said bulb in a longitudinal direction and in a limited area within 10–200 degrees with respect to an entire circumference of said bulb; and rare gas sealed in said bulb, wherein at least one of said main electrodes includes a metallic member sealed at a first end of said bulb and a sintered metal member mounted to the metallic member, and wherein an end of the sintered metal member facing the other main electrode has a slope extending to a side face of the sintered metal member such as to define a tip at said sintered metal member, and wherein said tip is positioned in a space covered by the limited area of said trigger electrode.

2. The discharge lamp as defined in claim 1, wherein the sintered metal member is shaped in a cylinder having a first end sloped and a second end coupled to the metallic member.

3. The discharge lamp as defined in claim 1, wherein the sintered metal member is shaped in a polygonal pillar having a first end slanted and a second end coupled to the metallic member.

4. A discharge lamp comprising:

a glass bulb;

a pair of metallic sealant members sealing both ends of said glass bulb;

a pair of main electrodes mounted to said metallic sealant members, respectively;

a trigger electrode provided on an outer surface of said bulb in a longitudinal direction and in a limited area within 10–200 degrees with respect to an entire circumference of said bulb; and rare gas sealed in said bulb wherein at least one of said main electrodes includes a metallic member mounted to said metallic sealant member and a sintered metal member mounted to the metallic member, the sintered metal member facing the other main electrode, and wherein an end of the sintered metal member facing the other main electrode has a slope extending to a side face of the sintered metal member such as to define a tip at said sintered metal member, and wherein said tip is positioned in a space covered by the limited area of said trigger electrode.

5. The discharge lamp as defined in claim 4, wherein the sintered metal member is shaped in a cylinder having a first end sloped and a second end coupled to the metallic member.

6. The discharge lamp as defined in claim 4, wherein the sintered metal member is shaped in a polygonal pillar having a first end slanted and a second end coupled to the metallic member.

7. A discharge lamp comprising:

a glass bulb;

a pair of metallic sealant members sealing both ends of said glass bulb;

a pair of main electrodes mounted to said metallic sealant members, respectively;

a trigger electrode provided on an outer surface of said bulb in a longitudinal direction and in a limited area within 10–200 degrees with respect to an entire circumference of said bulb; and rare gas sealed in said bulb, wherein at least one of said main electrodes is made of a sintered metal member, and wherein an end of the sintered metal member facing the other main electrode has a slope extending to a side face of the sintered metal member such as to define a tip at said sintered metal member, and wherein said tip is positioned in a space covered by the limited area of said trigger electrode.

8. The discharge lamp as defined in claim 7, wherein the sintered metal member is shaped in a cylinder having a first end sloped and a second end coupled to the metallic member.

9. The discharge lamp as defined in claim 7, wherein the sintered metal member is shaped in a polygonal pillar having a first end slanted and a second end coupled to the metallic member.

10. An electronic flash device comprising:

a power source;

a main discharging capacitor charged by said power source;

a trigger circuit;

a discharge limp having a trigger electrode that receives a voltage from said trigger circuit, said discharge lamp emitting light by consuming energy charged in said main discharging capacitor;

a photo-receptor for receiving reflective light, but of light emitted from said discharge lamp, from a photographic object;

a light-emission-halting-signal-generating circuit for generating a light-emission-halting signal when said photo-receptor receives the reflective light up to a predetermined amount; and a light-emission halting section for halting said discharge lamp to emit light by receiving the light-emission halting signals, wherein said discharge lamp comprises:

a glass bulb;

a pair of main electrodes sealed in at both ends of said glass bulb, respectively;

a trigger electrode provided on an outer surface of said bulb in a longitudinal direction and in a limited area within 10–200 degrees with respect to an entire circumference of said bulb; and rare gas sealed in said bulb, wherein at least one of said main electrodes includes a metallic member sealed at a first end of said bulb and a sintered metal member mounted to the metallic member, and wherein an end of the sintered metal member facing the other main electrode has a slope extending to a side face of the sintered metal member such as to define a tip at said sintered metal member, and wherein said tip is positioned in a space covered by the limited area of said trigger electrode.

11. The electronic flash device of claim 10, wherein the body of the sintered metal member forms a cylinder.

12. The electronic flash device of claim 10, wherein the body of the sintered metal member forms a polygon.

13. An electronic flash device comprising:

a power source;

a main discharging capacitor charged by said power source;

a trigger circuit;

a discharge lamp having a trigger electrode that receives a voltage from said trigger circuit, said discharge lamp emitting light by consuming energy charged in said main discharging capacitor;

a photo-receptor for receiving reflective light, out of light emitted from said discharge lamp, from a photographic object;

a light-emission-halting-signal-generating circuit for generating a light-emission-halting signal when said photo-receptor receives the reflective light up to a predetermined amount; and a light-emission halting section for halting said discharge lamp to emit light by receiving the light-emission halting signal, wherein said discharge lamp comprises:

a glass bulb;

a pair of metallic sealant members sealing both ends of said glass bulb;

a pair of main electrodes mounted to said metallic sealant members, respectively;

a trigger electrode provided on an outer surface of said bulb in a longitudinal direction and in a limited area within 10–200 degrees with respect to an entire circumference of said bulb; and rare gas sealed in said bulb;

wherein at least one of said main electrodes includes a metallic member mounted to said metallic sealant member and a sintered metal member mounted to the metallic member, the sintered metal member facing the other main electrode, and wherein an end of the sintered metal member facing the other main electrode has a slope extending to a side face of the sintered metal member such as to define a tip at said sintered metal member, and wherein said tip is positioned in a space covered by the limited area of said trigger electrode.

14. An electronic flash device comprising:

a power source;

a main discharging capacitor charged by said power source;

a trigger circuit;

a discharge lamp having a trigger electrode that receives a voltage from said trigger circuit, said discharge lamp emitting light by consuming energy charged in said main discharging capacitor;

a photo-receptor for receiving reflective light, out of light emitted from said discharge lamp, from a photographic object;

a light-emission-halting-signal-generating circuit for generating a light-emission-halting signal when said photo-receptor receives the reflective light up to a predetermined amount; and a light-emission halting section for halting said discharge lamp from emitting light by receiving the light-emission halting signal, wherein said discharge lamp comprises:

a glass bulb;

a pair of metallic sealant members sealing both ends of said glass bulb;

a pair of main electrodes mounted to said metallic sealant members, respectively;

a trigger electrode provided on an outer surface of said bulb in a longitudinal direction and in a limited area within 10–200 degrees with respect to an entire circumference of said bulb; and rare gas sealed in said bulb, wherein at least one of said main electrodes is made of a sintered metal member, and wherein an end of the sintered metal member facing the other main electrode has a slope extending to a side face of the sintered metal member such as to define a tip at said sintered metal member, and wherein said tip is positioned in a space covered by the limited area of said trigger electrode.

15. The electronic flash device of claim 14, wherein the body of the sintered metal member forms a cylinder.

16. The electronic flash device of claim 14, wherein the body of the sintered metal member forms a polygon.

* * * * *

UNITED STATES PATENT AND TRADEMARK OFFICE

CERTIFICATE OF CORRECTION

PATENT NO. : 6,531,832 B2
DATED : March 11, 2001
INVENTOR(S) : Shinji Hirata et al.

It is certified that error appears in the above-identified patent and that said Letters Patent is hereby corrected as shown below:

Column 8,
Line 6, replace “a discharge limp” with -- a discharge lamp --.
Line 10, replace “but of light” with -- out of light --.

Signed and Sealed this

Nineteenth Day of August, 2003

JAMES E. ROGAN
*Director of the United States Patent and Trademark Office*